US012668967B2

(12) United States Patent
Pei et al.

(10) Patent No.: US 12,668,967 B2
(45) Date of Patent: Jun. 30, 2026

(54) QUICK INSTALLATION STRUCTURE FOR SUNROOM AND SUNROOM

(71) Applicant: PINGHU LEYOU SANITARY WARE CO., LTD., Pinghu (CN)

(72) Inventors: Yang Pei, Pinghu (CN); Jianzhong Cai, Pinghu (CN)

(73) Assignee: PINGHU LEYOU SANITARY WARE CO., LTD., Pinghu (CN)

( * ) Notice: Subject to any disclaimer, the term of this patent is extended or adjusted under 35 U.S.C. 154(b) by 280 days.

(21) Appl. No.: 18/617,854

(22) Filed: Mar. 27, 2024

(65) Prior Publication Data

US 2025/0092661 A1 Mar. 20, 2025

(30) Foreign Application Priority Data

Sep. 14, 2023 (CN) ..... 202322490568.3
Mar. 7, 2024 (CN) ..... 202420435746.4

(51) Int. Cl.
*E04B 1/24* (2006.01)

(52) U.S. Cl.
CPC .... *E04B 1/2403* (2013.01); *E04B 2001/2409* (2013.01); *E04B 2001/2451* (2013.01); *E04B 2001/2481* (2013.01); *E04B 2001/249* (2013.01)

(58) Field of Classification Search
CPC ..... E04B 2001/249; E04B 2001/2487; E04B 7/06; E04B 7/107; E04B 7/16; E04B 7/163; E04D 1/2914; E04D 1/13; E04D 1/3402; E04D 2001/305; E04D 2001/3438; E04D 2003/0875
See application file for complete search history.

(56) References Cited

U.S. PATENT DOCUMENTS

| | | | | |
|---|---|---|---|---|
| 11,008,758 | B2 * | 5/2021 | Laetgaard | E04B 7/18 |
| 2020/0315101 | A1 * | 10/2020 | Nowe | A01G 9/14 |
| 2021/0172175 | A1 * | 6/2021 | Allesen | E04D 13/03 |
| 2022/0228361 | A1 * | 7/2022 | Hoddinott | E04B 1/344 |

FOREIGN PATENT DOCUMENTS

| | | | |
|---|---|---|---|
| CN | 203532430 | A | 4/2014 |

* cited by examiner

*Primary Examiner* — Joshua J Michener
*Assistant Examiner* — Henry Hooper Mudd
(74) *Attorney, Agent, or Firm* — Birchwood IP

(57) ABSTRACT

A quick installation structure for a sunroom and a sunroom are provided, where the quick installation structure includes: a connecting rod; a crossbeam providing with a first connecting unit and a second connecting unit; a connector connected to the connecting rod and including a locking portion, a pushing portion, and an actuating portion. The pushing portion matches with the locking portion, the actuating portion is connected to the locking portion and controls its movement. The locking portion is subjected by the pushing portion during movement and switches between a first state and a second state; the first connecting unit and the second connecting unit are extended to two sides of the crossbeam, both the first connecting unit and the second connecting unit include a connecting portion, which includes a first wall portion and a second wall portion.

16 Claims, 17 Drawing Sheets

QUICK INSTALLATION STRUCTURE FOR SUNROOM AND SUNROOM

CROSS-REFERENCE TO RELATED APPLICATIONS

This application claims priority to Chinese Patent Application No. 202420435746.4, filed on Mar. 7, 2024, and Chinese Patent Application No. 202322490568.3, filed on Sep. 14, 2023, which is hereby incorporated by reference in its entirety.

TECHNICAL FIELD

The present disclosure relates to a quick installation structure for a sunroom and a sunroom.

BACKGROUND

Sunroom is also called as a glass room, is all bright and non-traditional building with glass and metal frames to achieve a goal of enjoying sunlight and getting close to nature. At present, there are various structural forms of sunrooms, among which the ceiling of the sunroom built on the wall mainly includes a frame structure composed of a main beam, a rear beam, a front beam, and a column, this frame structure is used to support the glass room.

A three-clamping lock with Chinese utility model patent application number of 201320577635.9 includes a lock shell, a three-clamping spring plate, and an eccentric wheel. The three-clamping spring plate is arranged in the lock shell, a hole is provided on the three-clamping spring plate to match the eccentric wheel. The three-clamping spring plate moves forward and backward through the rotation of the eccentric wheel arranged in the hole. The lock shell is made of a seamless steel tube with a rectangular cross-section, a rear cover is arranged at a rear end of the lock shell, an inner side of the rear cover is provided with a lower support for supporting the rear end of the three-clamping spring plate. The three-clamping locks mentioned in the following specification are all of this structure.

In existing technology, most frames of sunrooms are fixed and connected by fixed screws, the screw connections are also used in various connectors. The excessive number of screw connections during installation is time-consuming and laborious.

SUMMARY

The purpose of the present disclosure is to propose a fast installation structure and a sunroom suitable for the existing technology to address the above-mentioned problems.

The purpose of the embodiments of the present disclosure can be achieved through the following technical solutions: a fast installation structure for a sunroom, including:

a connecting rod;

a crossbeam, which is provided with a first connecting unit and a second connecting unit;

a connector, which is connected to the connecting rod and includes a locking portion, a pushing portion, and an actuating portion; the pushing portion matches with the locking portion, the actuating portion is connected to the locking portion and controls its movement; the locking portion is subjected by the pushing portion during movement and switches between a first state and a second state;

the first connecting unit and the second connecting unit are symmetrically extended to two sides of the crossbeam, both the first connecting unit and the second connecting unit include a connecting portion, the connecting portion includes a first wall portion and a second wall portion; a groove is formed between the first wall portion and the second wall portion for the locking portion to be inserted, a first stop portion is formed on the first wall portion, a second stop portion is formed on the second wall portion;

when the locking portion is in the first state, it can freely pass through between the first stop portion and second stop portion; when the locking portion is in the second state, the locking portion is limited by the first stop portion and the second stop portion so as to limit it from detaching from the connecting portion between the first stop portion and the second stop portion.

The first connecting unit and the second connecting unit in the embodiment of the present disclosure both include a third insertion slot, the connecting rod is provided with a first insertion slot, the first insertion slot corresponds to the third insertion slot.

An angle between the first connecting unit and the second connecting unit on the same crossbeam in the embodiment of the present disclosure is 95-135 degrees.

The crossbeam in the embodiment of the present disclosure is provided with three groups, the three groups of crossbeams are respectively connected by the connecting rod and connector; the first connecting unit of one group of two groups of the crossbeams provided on two sides is parallel to the second connecting unit in the other group of the crossbeams.

The locking portion of the embodiment of the present disclosure includes a first locking sheet and a second locking sheet, the first locking sheet has a first bending part, the second locking sheet has a second bending part, the first bending part is arranged in an opposite direction to the second bending part; in the second state, the first bending part abuts against the first stop portion, the second bending part abuts against the second stop portion.

The actuating portion includes an end, a shaft, and a cam, the shaft is connected to the end, the cam is provided on the shaft, an axis of the cam is spaced from the axis of the shaft; the first locking sheet and the second locking sheet are formed on the same sheet, the sheet has a hole that fits with the cam, the end is exposed to an outside of the connecting rod.

The embodiment of the present disclosure further provides a sunroom, which includes:

a base frame, which is enclosed in a square shape;

a side panel structure, which is fixed to the base frame;

a door panel structure, which is fixed to the base frame;

a top panel structure, which forms a top of the sunroom and is connected to the side panel structure and/or door panel structure;

at least one of the side panel structure, door panel structure, or top panel structure includes a quick installation structure, where the quick installation structure includes:

a connecting rod;

a crossbeam, which is provided with a first connecting unit and a second connecting unit;

a connector, which is connected to the connecting rod and includes a locking portion, a pushing portion, and an actuating portion; the pushing portion matches with the locking portion, the actuating portion is connected to the locking portion and controls its movement; the locking portion is subjected by the pushing portion during movement and switches between a first state and a second state;

the first connecting unit and the second connecting unit are symmetrically extended to two sides of the crossbeam, both the first connecting unit and the second connecting unit include a connecting portion, the connecting portion includes a first wall portion and a second wall portion; a groove is formed between the first wall portion and the second wall portion for the locking portion to be inserted, a first stop portion is formed on the first wall portion, a second stop portion is formed on the second wall portion;

when the locking portion is in the first state, it can freely pass through between the first stop portion and second stop portion; when the locking portion is in the second state, the locking portion is limited by the first stop portion and the second stop portion so as to limit it from detaching from the connecting portion between the first stop portion and the second stop portion.

An embodiment of the present disclosure further includes an insulation panel, at least two sides of the insulation panel are respectively inserted into a third insertion slot of the crossbeam and a first insertion slot of the connecting rod that is connected to the crossbeam.

The side panel structure in the embodiment of the present disclosure is provided with two groups, the two groups of side panel structures are provided on two sides of the top panel structure, the side panel structure includes the quick installation structure, the other end of the connecting rod of the quick installation structure relative to the crossbeam that it is connected to is connected to the base frame.

The crossbeam of the quick installation structure of one group of the side panel structures in the embodiment of the present disclosure is connected to a drainage channel.

A column connection is provided between the side panel structure and the door panel structure that are adjacent in the embodiment of the present disclosure.

The top panel structure in the embodiment of the present disclosure includes the quick installation structure, the first connecting unit and second connecting unit of the crossbeam of the quick installation structure are respectively connected to the connecting rod through the connector, the other end of the connecting rod that it is connected to the crossbeam is connected to the crossbeam of the quick installation structure of the side panel structure through the connector.

The top panel structure of the embodiment of the present disclosure includes a skylight.

The door panel structure of an embodiment of the present disclosure includes a door, which is connected to the door panel structure through a connecting mechanism to achieve a translation or rotation opening of the door.

The door panel structure in the embodiment of the present disclosure includes:

a second connecting rod, two second connecting rods are provided, a bottom of each second connecting rod is connected to the base frame, a top thereof abuts against the top panel structure;

a horizontal plug-in beam, two ends of the horizontal plug-in beam are connected to two second connecting rods;

a horizontal connecting rod, several horizontal connecting rods are provided, one end of each horizontal connecting rod is connected to one side of the second connecting rod, and the other end thereof is connected to the side panel structure;

the second connecting rod, horizontal plug-in beam, and horizontal connecting rod are all provided with a second insertion groove, the door is installed between two second connecting rods.

The door panel structure and the side panel structure are further connected to a first support rod for support in an embodiment of the present disclosure.

Compared with the existing technology, the advantages of the present application are: it quickly fixes the top panel structure and side panel structure by providing with a clamp edge on the base frame and a flipping edge on the crossbeam, and setting this structure in combination with the connector for clamping and locking; the insulation panel is inserted into the first, second, and third insertion slots, the connection between the third connecting rod and the column is fixed, thereby ensuring a stable connection between the top panel structure and the door panel structure.

DESCRIPTION OF EMBODIMENTS

Figure 1:
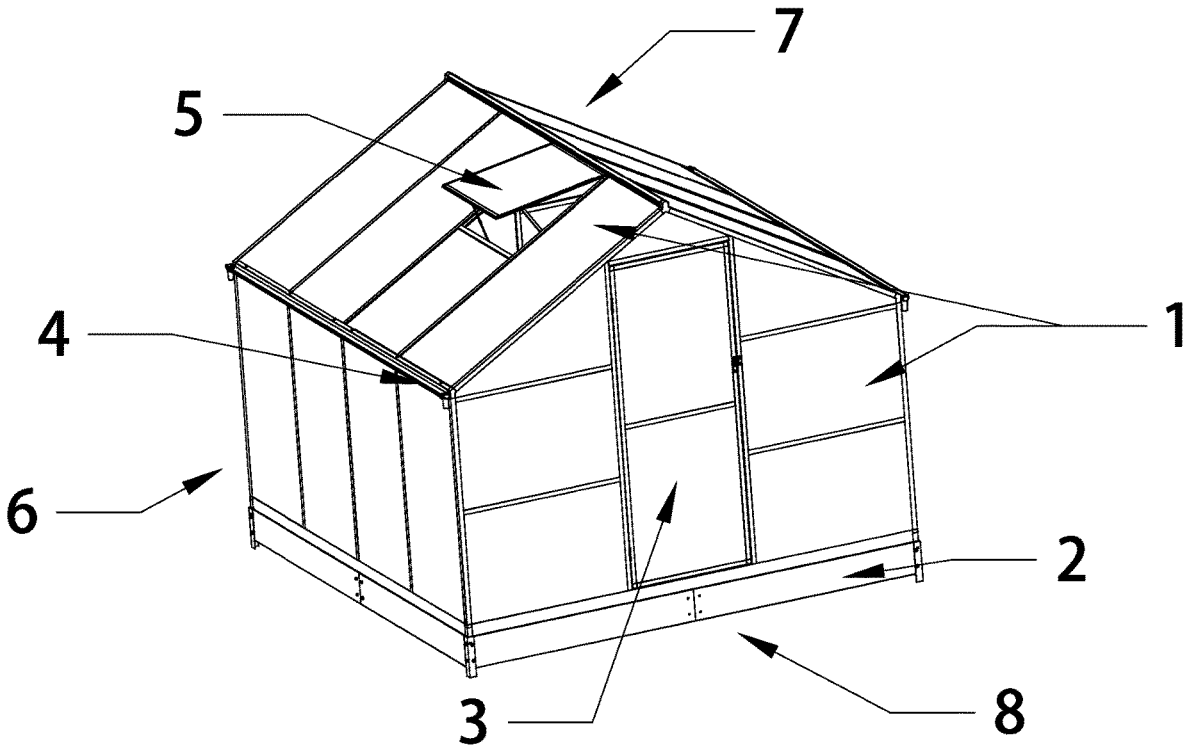
FIG. 1 is a schematic diagram of a hinged door model for a sunroom.
Figure 2:
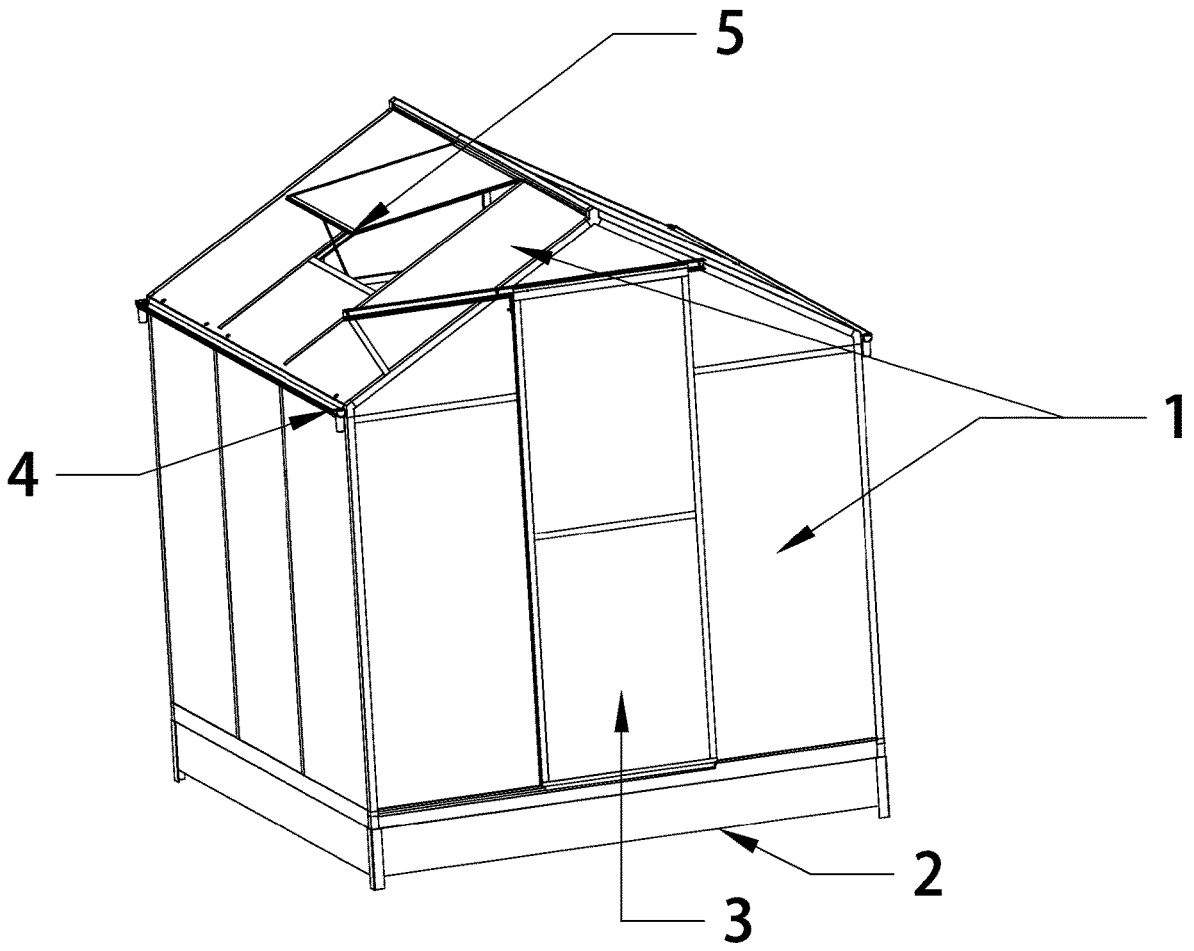
FIG. 2 is a schematic diagram of a sliding door model for the sunroom.
Figure 3:
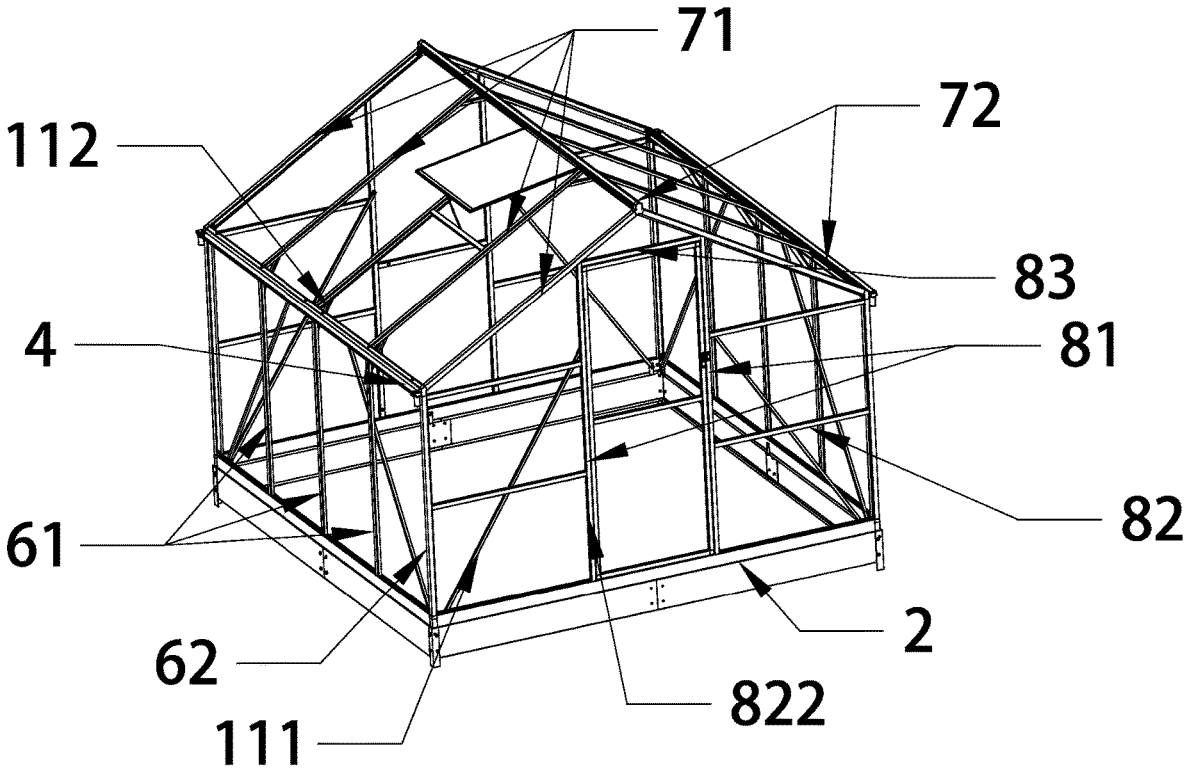
FIG. 3 is a schematic diagram of a frame of the sunroom.
Figure 4:
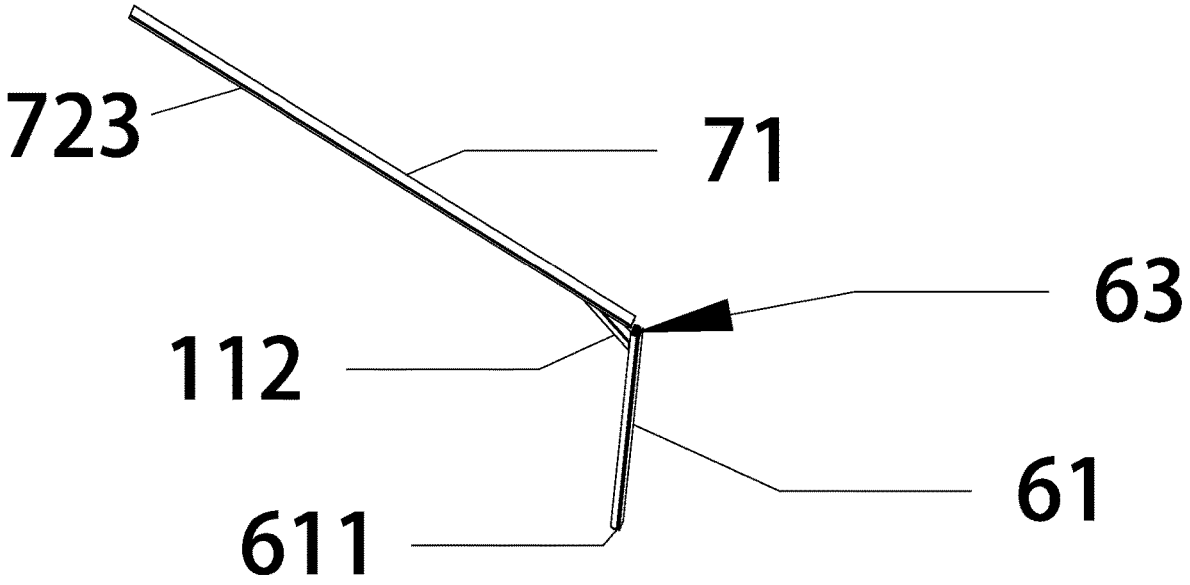
FIG. 4 is a schematic diagram of a first connecting rod and a third connecting rod.
Figure 5:
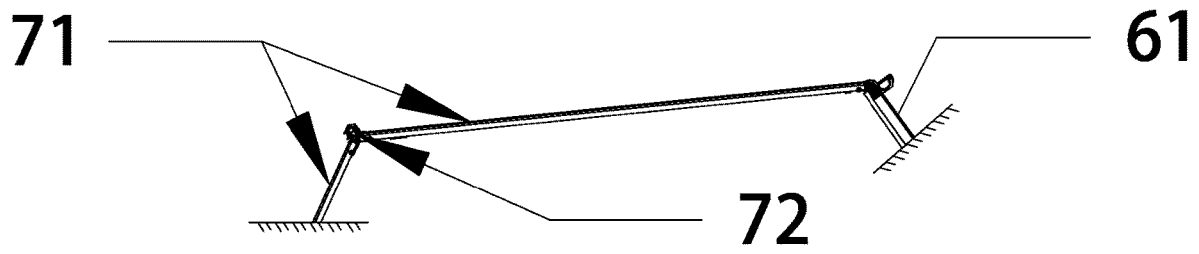
FIG. 5 is a schematic diagram of an obtuse angle beam connection.
Figure 6:
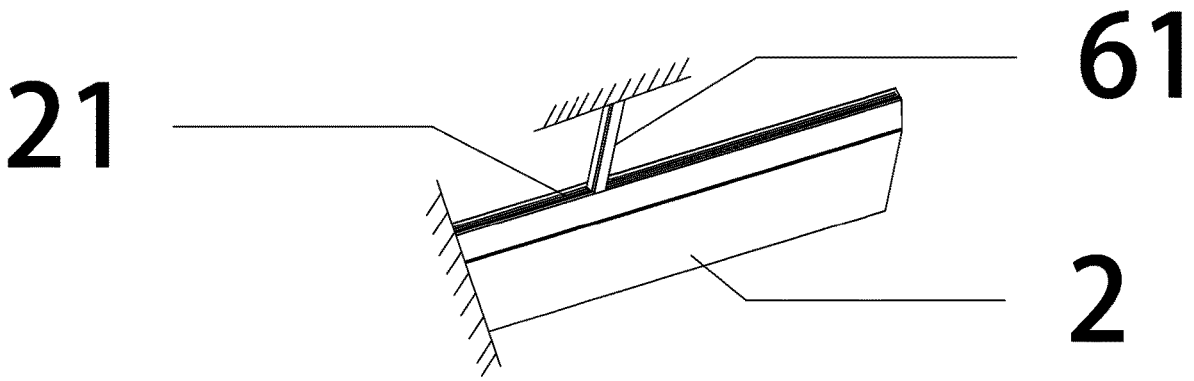
FIG. 6 is a schematic diagram of a base frame.
Figure 7:
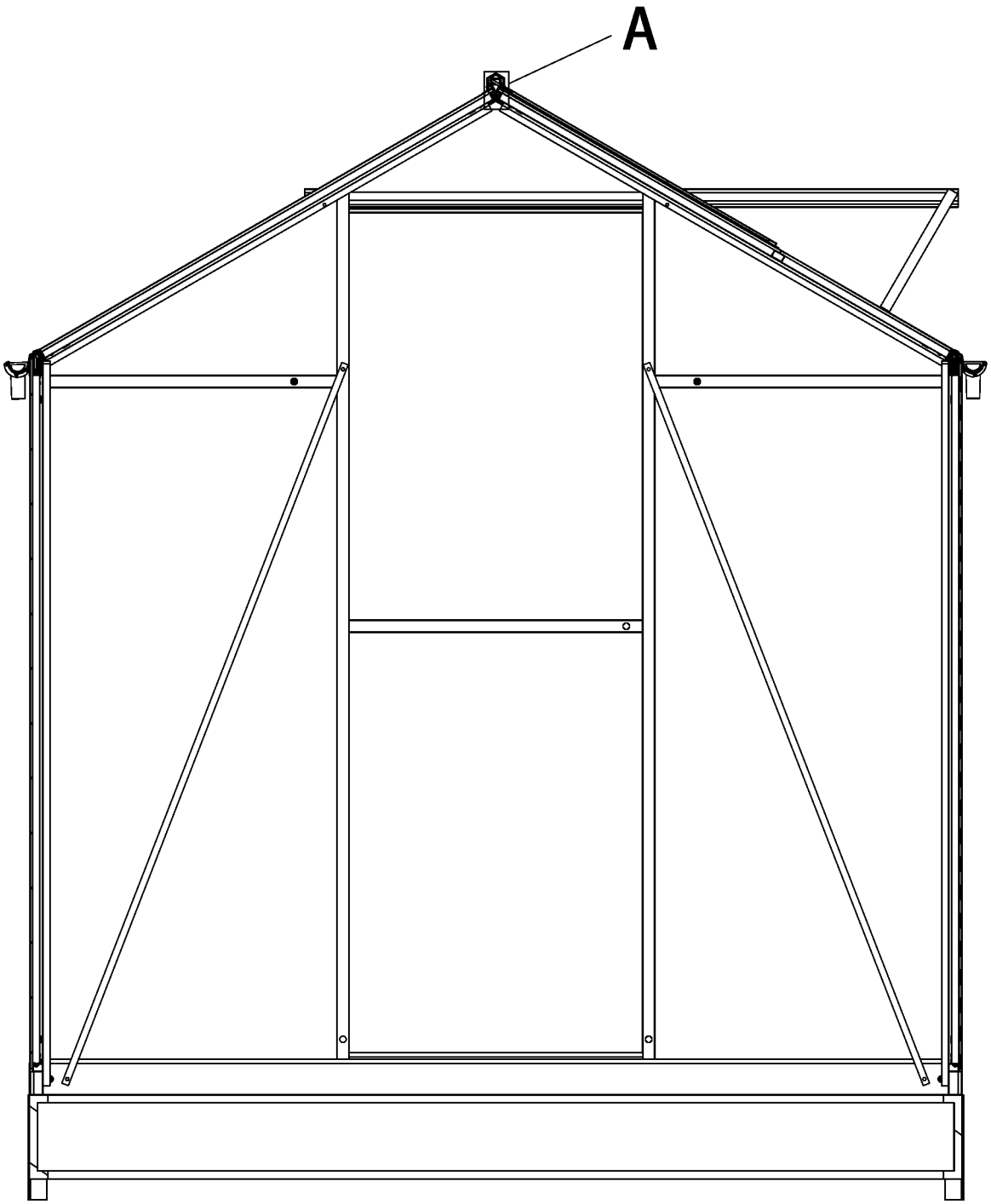
FIG. 7 is a schematic diagram of a sectional structure of the sunroom.

The following are specific embodiments of the present disclosure and further describe the technical solution of the present disclosure in combination with the accompanying drawings.

As shown in FIGS. 7 to 17, a quick installation structure for a sunroom includes a connecting rod 10, a crossbeam 72, and a connector 63.

The crossbeam 72 in this embodiment is provided with a first connecting unit 721 and a second connecting unit 722.

In this embodiment, the connector 63 is connected to the connecting rod 10 and includes a locking portion 631, a pushing portion 632, and an actuating portion 633. The pushing portion 632 matches with the locking portion 631, the actuating portion 633 is connected to the locking portion 631 and controls its movement. The locking portion 631 switches between a first state and a second state during movement due to an action of the pushing portion 632.

The first connecting unit 721 and the second connecting unit 722 in this embodiment are systematically extended to two sides of the crossbeam 72, both the first connecting unit 721 and the second connecting unit 722 include a connecting portion 720, which includes a first wall portion 7201 and a second wall portion 7202. A groove portion 7203 is formed between the first wall portion 7201 and the second wall portion 7202 for the locking portion 631 to be inserted, a first stop portion 72011 is formed on the first wall portion 7201, a second stop portion 72021 is formed on the second wall portion 7202.

When the locking portion 631 in this embodiment is in the first state, it can freely pass through between the first stopping portion 72011 and the second stopping portion 72021; when the locking portion 631 is in the second state, the locking portion 631 is limited by the first stopping portion 72011 and the second stopping portion 72021, thereby limiting its detachment from the connecting portion 720 between the first stopping portion 72011 and the second stopping portion 72021. In this way, a frame connection of the sunroom can be quickly completed.

An angle between the first connecting unit 721 and the second connecting unit 722 on the same crossbeam 72 in this embodiment is 95-135 degrees. When three crossbeams 72 are sequentially connected by the connecting rod 10, the connecting rod 10 on outer sides of the two crossbeams 72 provided on two sides are parallel. In other words, when three groups of crossbeams 72 are provided, the three groups of crossbeams 72 are respectively connected by the connecting rod 10 and the connector 63, the first connecting unit 721 of one group of two groups of crossbeams 72 provided on two sides is parallel to the second connecting unit 722 in the other group of the crossbeams. The first connecting unit 721 provided in one group of the crossbeams 72 is parallel to the connecting rod 10 of the second connecting unit 722 in another group of the crossbeams 72, which can form a side panel of the sunroom. A basic structure of these three groups of crossbeams 72 is the same, which include the first connecting unit 721 and the second connecting unit 722. The angle between the first connecting unit 721 and the second connecting unit 722 is 95-135 degrees, an installation angle is adjusted according to an actual environment.

Figure 16:
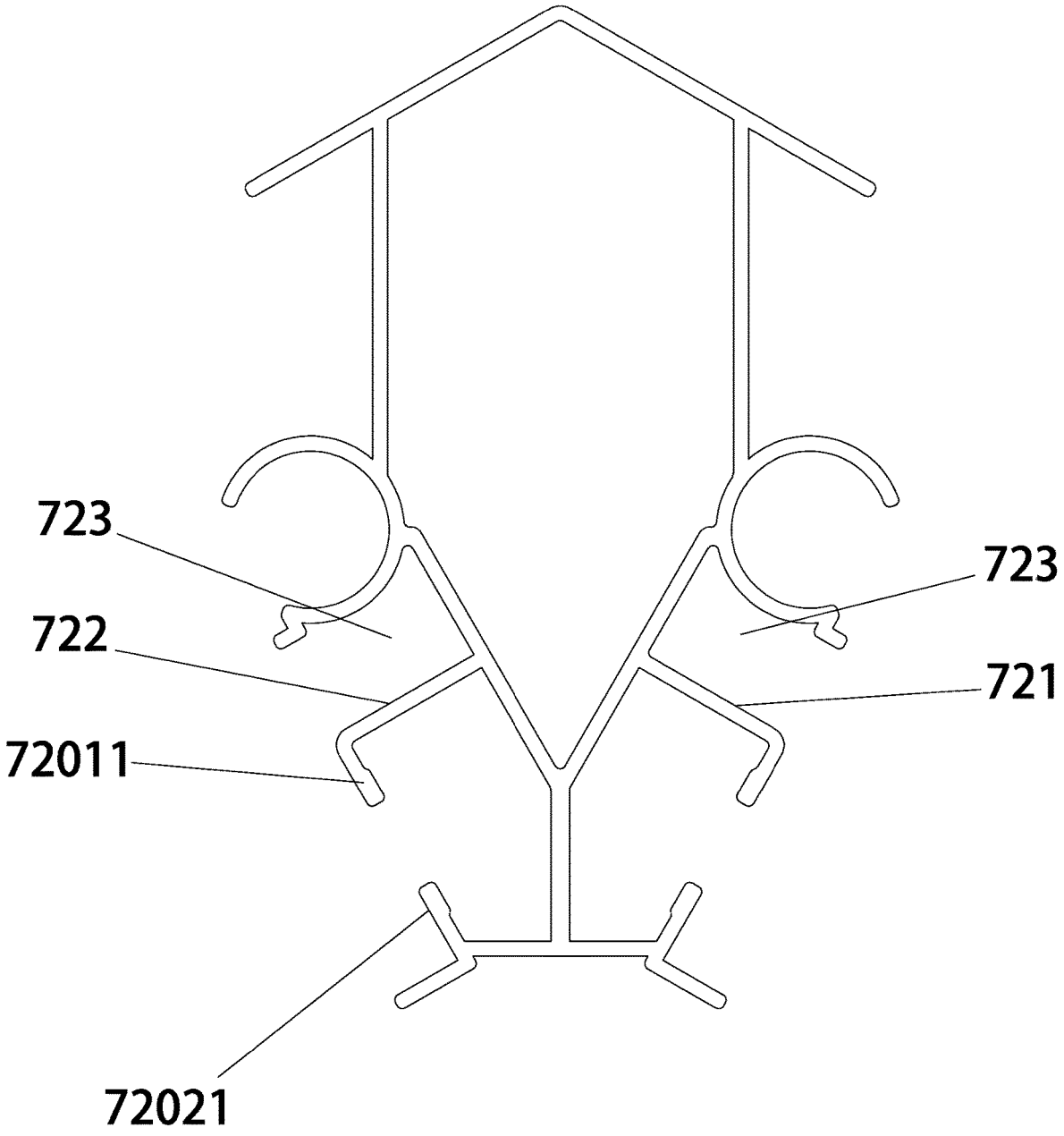
FIG. 16 is a structural schematic diagram of a crossbeam.
Figure 17:
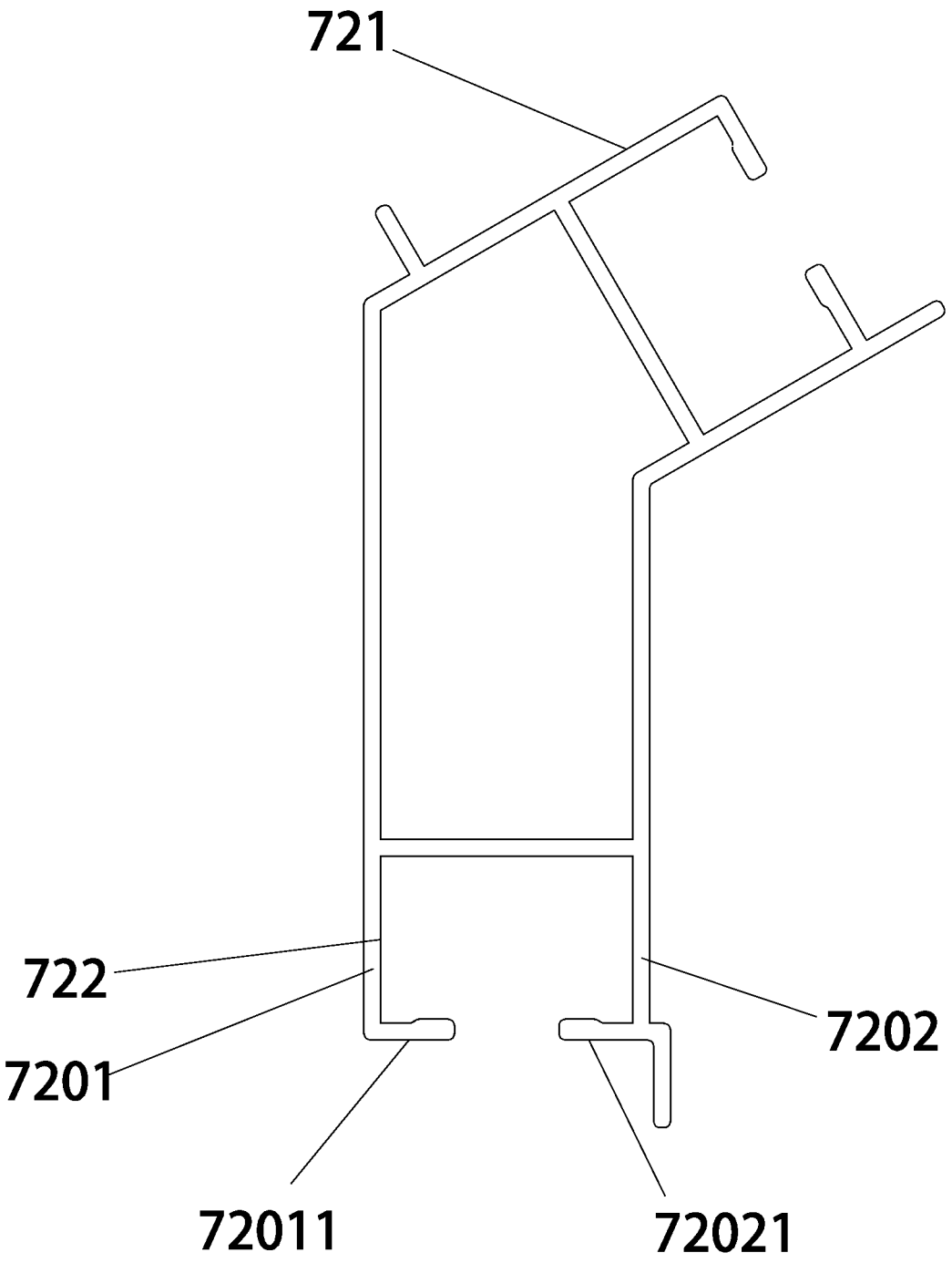
FIG. 17 is a structural schematic diagram of another crossbeam.

As shown in FIG. 16, the crossbeam 72 in a middle forms a top of a top panel structure 7, its first connecting unit 721 and second connecting unit 722 are arranged in a symmetrical or roughly symmetrical manner. As shown in FIG. 17, the first connecting unit 721 and the second connecting unit 722 of the crossbeam 72 provided on two sides can be set with different lengths. In addition, the first connecting unit 721 and the second connecting unit 722 also extend symmetrically in two directions.

Figure 8:
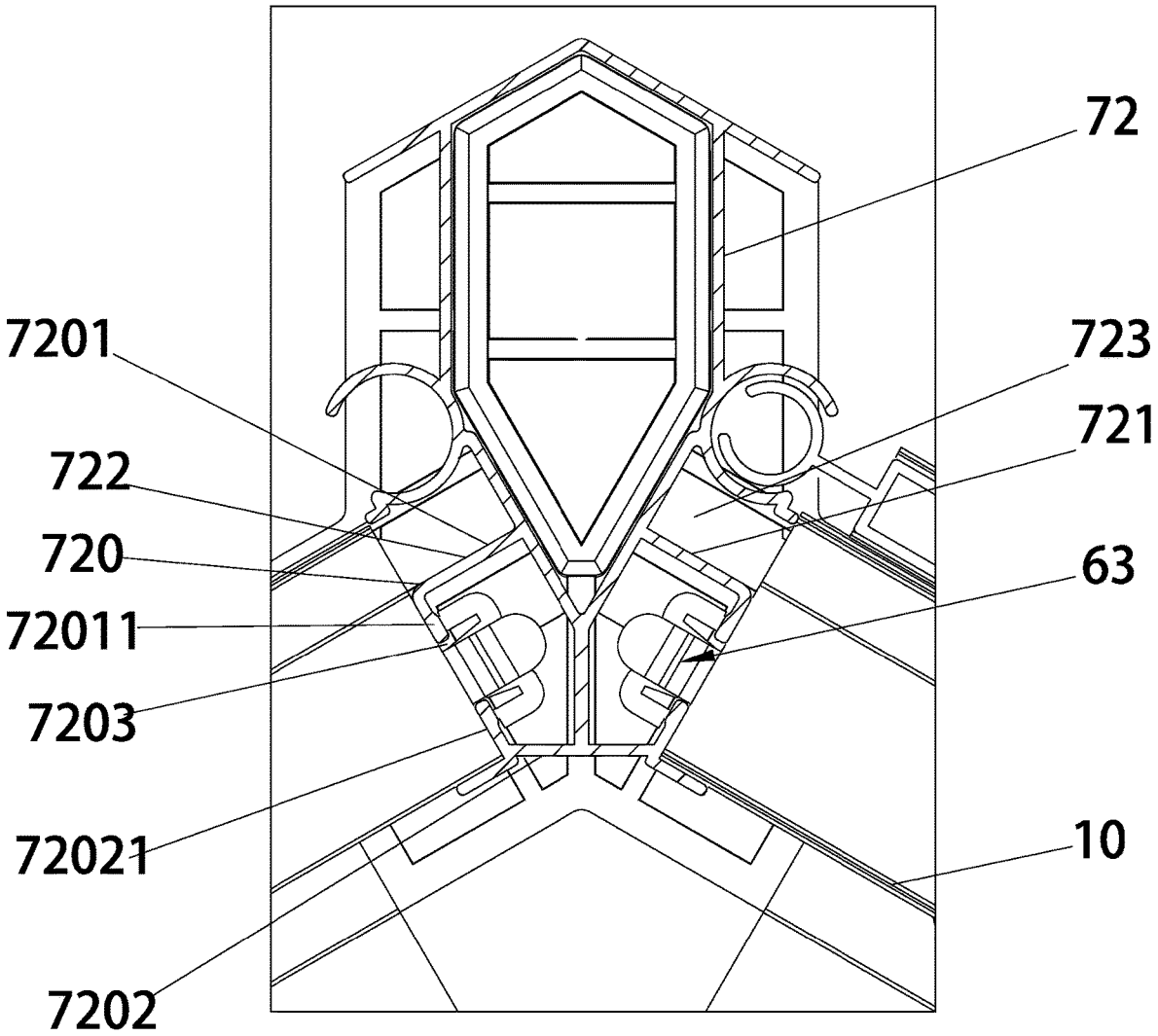
FIG. 8 is an enlarged view at point A in FIG. 7.
Figure 9:
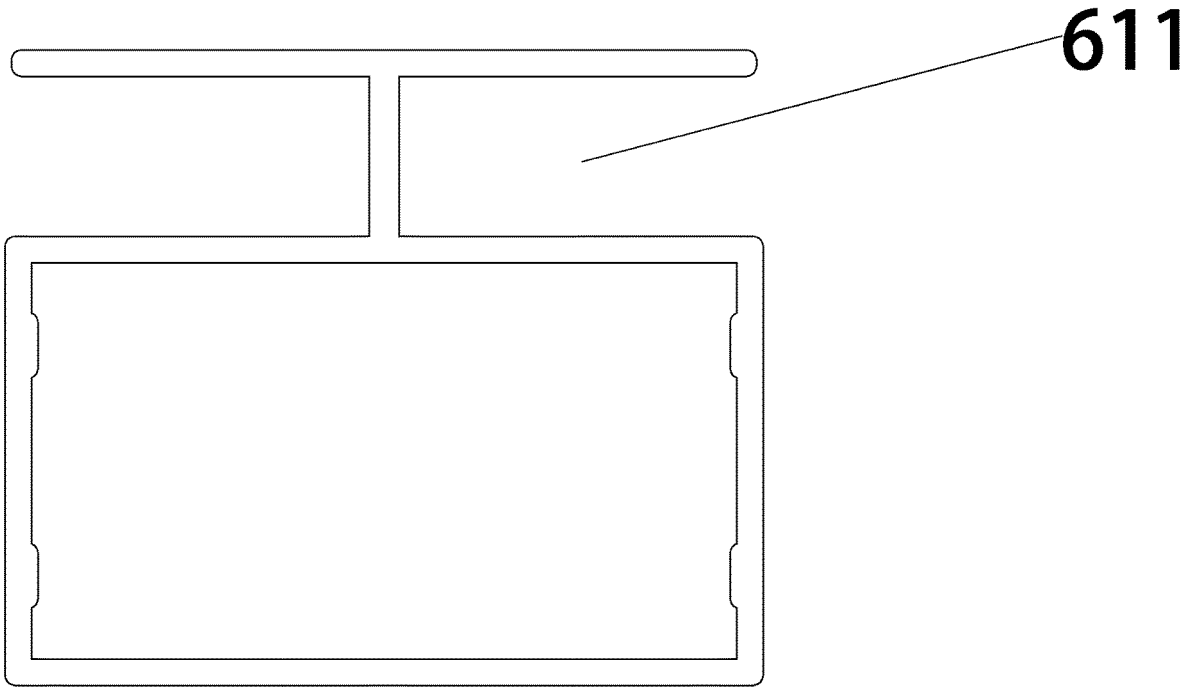
FIG. 9 is a cross-sectional view of the connecting rod.
Figure 10:
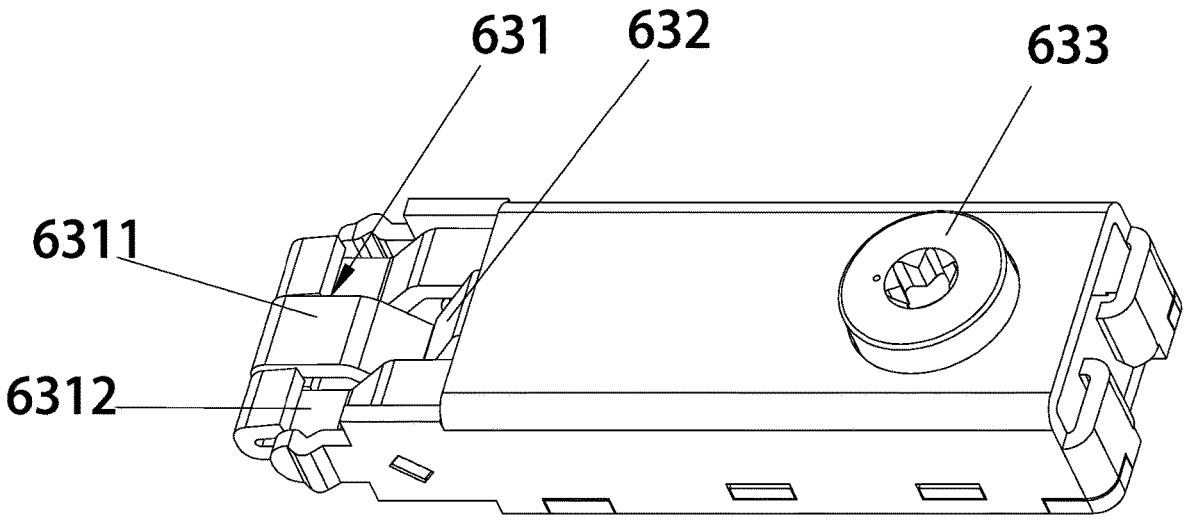
FIG. 10 is a schematic diagram of a three-dimensional structure of a connector in a first state.
Figure 11:
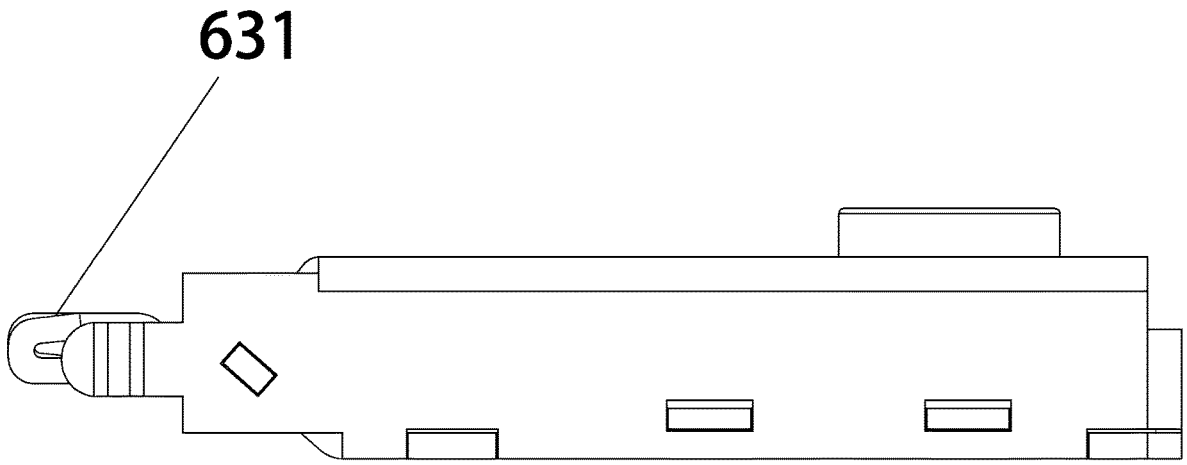
FIG. 11 is a front view of the connector in the first state.
Figure 12:
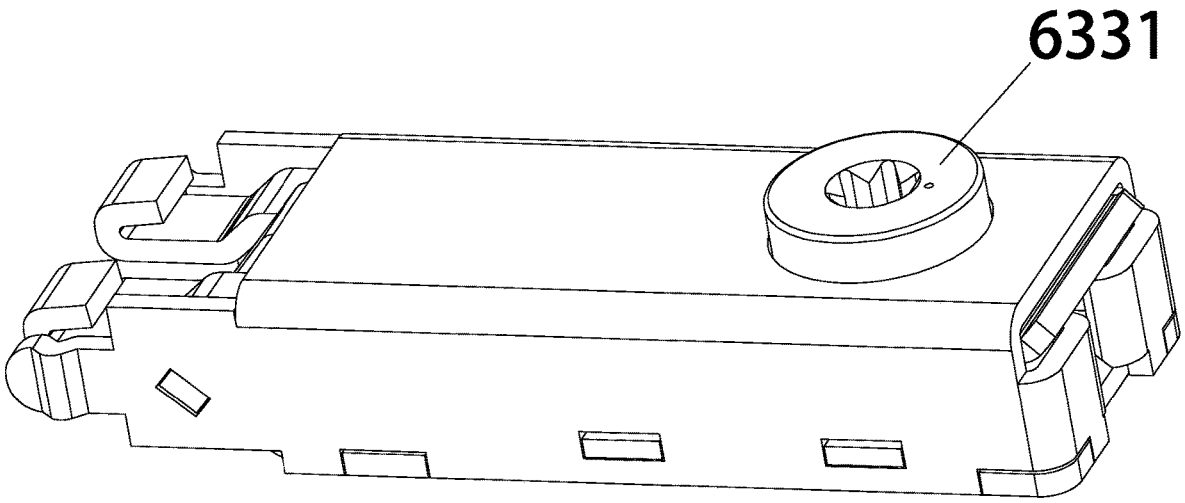
FIG. 12 is a schematic diagram of a three-dimensional structure of the connector in a second state.
Figure 13:
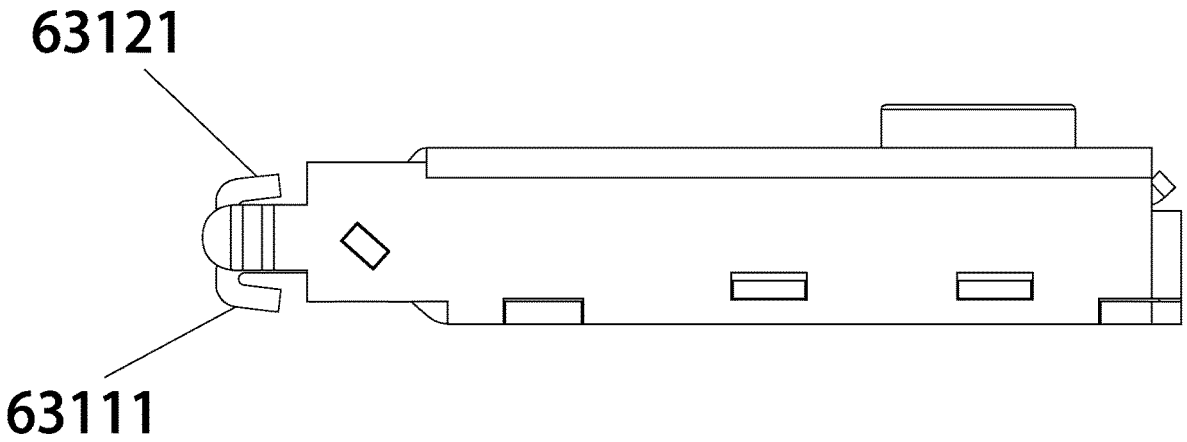
FIG. 13 is a front view of the connector in the second state.
Figure 14:
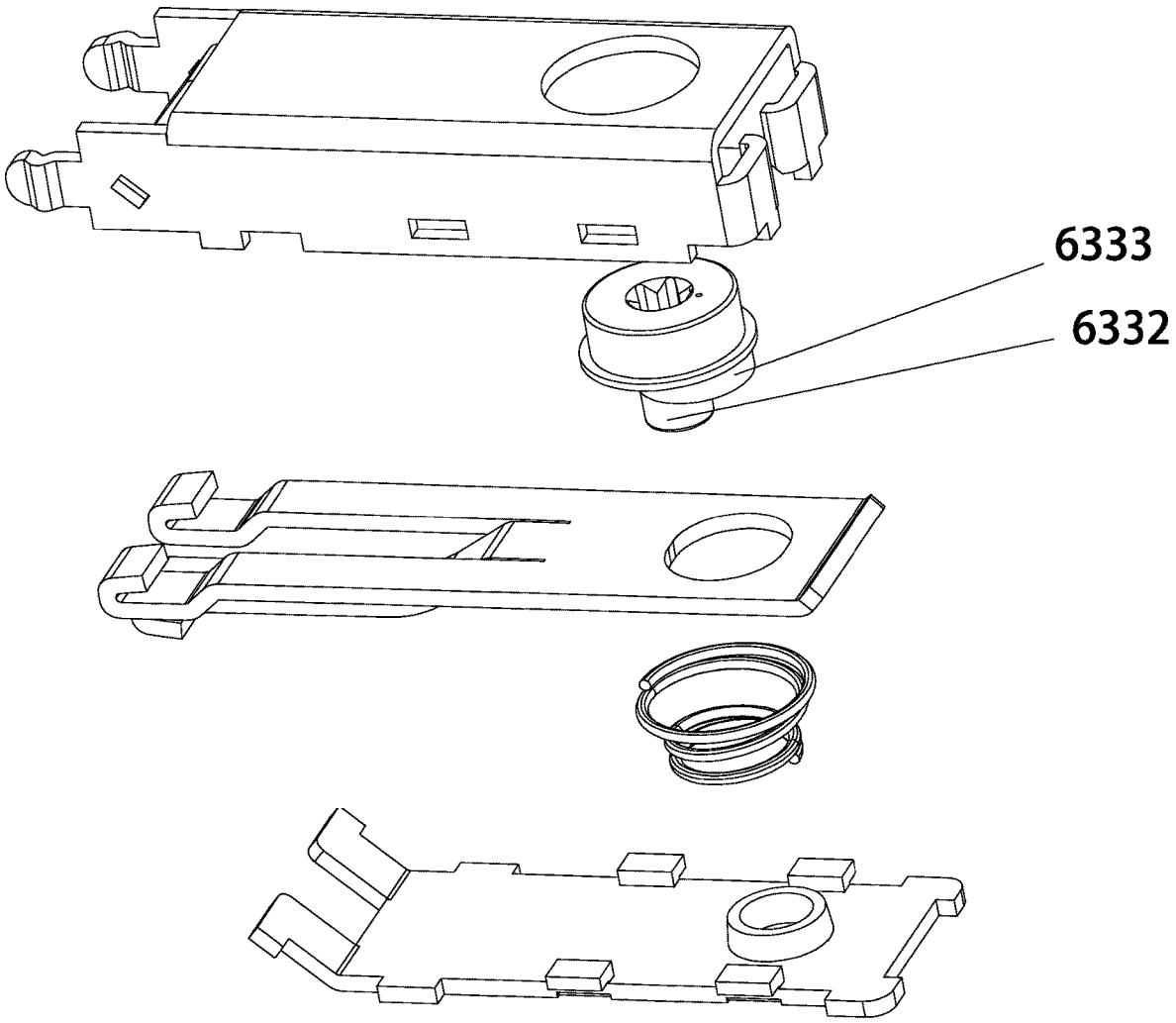
FIG. 14 is a schematic diagram of a decomposed structure of the connector.
Figure 15:
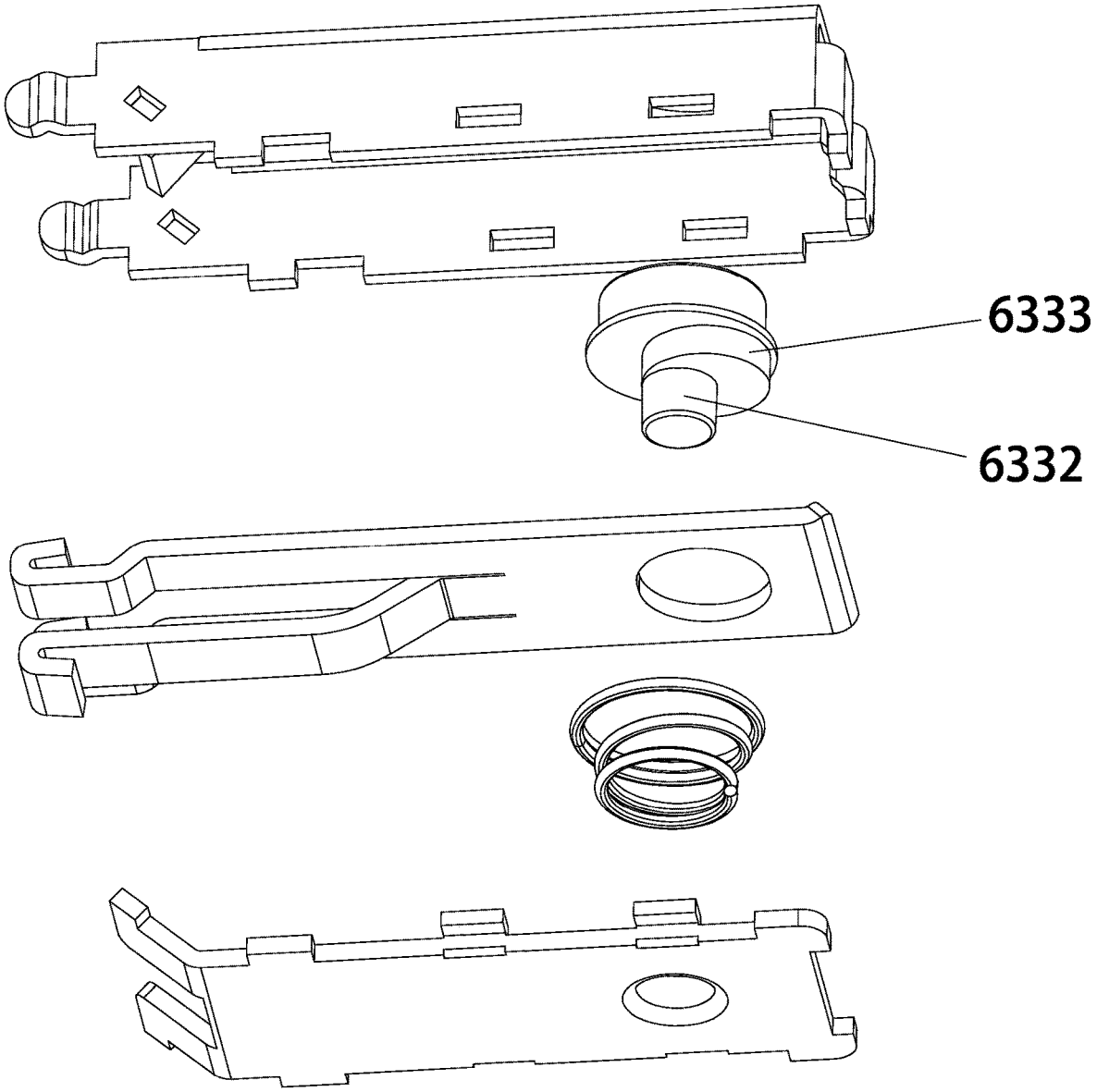
FIG. 15 is a schematic diagram of the decomposed structure of the connector in FIG. 2.

As shown in FIG. 8, in this embodiment, the first connecting unit 721 and the second connecting unit 722 of the crossbeam 72 located in the middle (crossbeam 72 of the top structure 7) both include a third insertion slot 723. The connecting rod 10 is provided with a first insertion slot 611, which corresponds to the third insertion slot 723 to facilitate the installation and support of a flat shaped insulation panel 1. As shown in FIG. 17, the crossbeam 72 provided on two sides may not have the third insertion slot 723.

The locking portion 631 in this embodiment includes a first locking sheet 6311 and a second locking sheet 6312. The first locking sheet 6311 includes a first bending portion 63111, the second locking sheet 6312 includes a second bending portion 63121. The first bending portion 63111 and the second bending portion 63121 are arranged in opposite directions. In the second state, the first bending portion 63111 abuts against the first stopping portion 72011, the second bending portion 63121 abuts against the second stop portion 72021.

The actuating portion 633 in this embodiment includes an end 6331, a shaft 6332, and a cam 6333. The shaft 6332 is connected to the end 6331, the cam 6333 is provided on the shaft 6332, an axis of the cam 6333 is spaced from the axis of the shaft 6332. The first locking sheet 6311 and the second locking sheet 6312 are formed on the same sheet, the sheet has a hole that fits with the cam 6333. The end 6331 is exposed to an outside of the connecting rod 10. When the end 6331 rotates, it drives the cam 6333 to rotate, the rotation of the cam 6333 can drive the locking portion 631 to move. During the movement, the pushing portion 632 pushes or moves away from the first locking sheet 6311 and/or the second locking sheet 6312, so that the locking portion 631 is subjected by the pushing portion 632 and switches between the first and second states.

The pushing portion 632 includes two parts. A first part is configured to push the first locking sheet 6311, and a second part is configured to push the second locking sheet 6312.

An inner hexagon or plum blossom groove can be provided on the end 6331 to facilitate the use of tools to rotate the actuating portion 633.

As shown in FIGS. 1-6, a sunroom includes:

a base frame 2, which is square or enclosed in a square shape;

a side panel structure 6, which is symmetrically arranged on two sides of the base frame 2;

a door panel structure 8, which is symmetrically arranged on the other sides of the base frame 2, the side panel structure 6 is connected to an adjacent edge of the door panel structure 8 through a plug-in connection;

a top panel structure 7, which forms a top of the sunroom, provided on the side panel structure 6 and the door panel structure 8, and fixedly connected to the side panel structure 6 and/or the door panel structure 8.

at least one of the side panel structure 6, door panel structure 8, or top panel structure 7 includes a quick installation structure, the quick installation structure includes:

a connecting rod 10;

a crossbeam 72, which is provided with a first connecting unit 721 and a second connecting unit 722;

a connector 63, which is connected to the connecting rod 10 and includes a locking portion 631, a pushing portion 632, and an actuating portion 633. The pushing portion 632 matches with the locking portion 631, the actuating portion 633 is connected to the locking portion 631 and controls its movement. The locking portion 631 is subjected by the pushing portion 633 and switches between a first state and a second state;

the first connecting unit 721 and the second connecting unit 722 are symmetrically extended to two sides of the crossbeam 72, both the first connecting unit 721 and the second connecting unit 722 include a connecting part 730; the connecting part 730 includes a first wall portion 7201 and a second wall portion 7202; a groove 7203 is formed between the first wall portion 7201 and the second wall portion 7202 for the locking portion 631 to be inserted, a first stop portion 72011 is formed on the first wall portion 7201, a second stop portion 72021 is formed on the second wall portion 7202;

when the locking portion 631 is in the first state, it can freely pass through between the first stopping portion 72011 and the second stopping portion 72021; when the locking portion 631 is in the second state, the locking portion 631 is limit by the first stopping portion 72011 and the second stopping portion 72021 so as to limiting it from detaching from the connecting portion 730 between the first stopping portion 72011 and the second stopping portion 72021.

This embodiment further includes an insulation panel 1, which is provided on the side panel structure 6, the door panel structure 8, and the top panel structure 7. The insulation panel 1 can use glass material or transparent plastic material from existing technology.

The top panel structure 7 is provided with a skylight 5, which is openable. Specifically, the skylight 5 can be opened by moving (through a track) or rotating (through a hinge). The door panel structure 8 is provided with a door 3, an adjacent side panel structure 6 is connected to the door panel structure 8 by a column 62. The door 3 can be opened by moving (through a track) or rotating (through a hinge).

Two groups of side panel structure 6 are provided, the two groups of side panel structures 6 are provided on two sides of the top panel structure 7, the side panel structure 6 includes the quick installation structure. The connecting rod 10 of the quick installation structure is connected to the other end of the crossbeam 72 that it is connected to and is connected to the base frame 2.

In other words, the side panel structure 6 includes a first connecting rod (connecting rod 10), which has several rods that are vertical arranged, the first connecting rod has a first insertion groove 611 for the insulation panel 1 to be inserted. The first connecting rod (connecting rod 10) forms the frame of the side panel structure 6. The connection between the first connecting rod (connecting rod 10) and the base frame 2 can also be connected using the connector 63, which will not be repeated here.

The door panel structure 8 includes:

a second connecting rod, two second connecting rods are provided, a bottom of each second connecting rod is connected to the base frame 2, a top thereof abuts against the top panel structure 7;

a horizontal plug-in beam 83, two ends of the horizontal plug-in beam are connected to two second connecting rods;

a horizontal connecting rod 82, several horizontal connecting rods are provided, one end of each horizontal connecting rod is connected to one side of the second connecting rod, and the other end thereof is connected to the side panel structure 6;

the second connecting rod, the horizontal plug-in beam 83, and the horizontal connecting rod 82 are all provided with a second insertion groove 822 for the insulation panel 1 to be inserted, the door 3 is installed between two second connecting rods;

the top panel structure 7 includes the quick installation structure, the first connecting unit 721 and the second connecting unit 722 of the crossbeam 72 of the quick installation structure are respectively connected to the connecting rod 10 through the connector 63, the other end of the connecting rod 10 relative to the crossbeam 72 that it is connected to is connected to the crossbeam 72 of the quick installation structure of the side panel structure 6 through the connector 63.

In other words, the top panel structure 7 includes: the crossbeam 72 which forms a horizontal frame of the top panel structure 7.

Several third connecting rod (connecting rod 10) are provided, its two ends are respectively connected to two crossbeams 72 through the connector 63. These two crossbeams 72 include the crossbeams 72 of the quick installation structure of the top panel structure 7 and the crossbeams 72 of the quick installation structure of the side panel structure 6.

The skylight 5 is provided between two adjacent third connecting rods (connecting rod 10).

The door panel structure 8 and the side panel structure 6 are also connected to a first support rod 111 for support.

A second support rod 112 is provided between the third connecting rod and the first connecting rod 61.

The crossbeam 72 of the quick installation structure of one of the side panel structures 6 is connected to a drainage channel 4. Specifically, the drainage channel 4 can be fixed to the crossbeam 72 through a bolt or welding.

A connection point of the third connecting rod, crossbeam 72, and column 62 is fixed with a connecting head that is fixed by insertion and thread.

The door 3 can be arranged as a hinged door or a sliding door.

In the present application, a main connecting structure is the crossbeam 72, the third connecting rod (connecting rod 10), the first connecting rod (connecting rod 10), the column 62, and the second connecting rod (connecting rod 10). Firstly, the column 62, the first connecting rod (connecting rod 10), and the second connecting rod (connecting rod 10) are fixed in the base frame 2 through the connector 63. Before the connector 63 is locked, the insulation panel 1 is installed, two crossbeams 72 are connected and fixed to the end of the column 62 through the connecting head, the connector 63 is locked required for the side panel structure 6. Then the horizontal connecting rod 82 is connected to the second connecting rod 81, and the horizontal plug-in beam 83 is installed to the upper end of the second connecting rod 81. The insulation panel 1 can be installed on the door panel structure 8. One end of the third connecting rod 71 is connected and fixed to the crossbeam 72 through the connector 63, thereby forming the top panel structure 7, then the top panel structure 7 is lift for installation, the other end of the third connecting rod 71 is assembled with the installed crossbeam 72 on the side panel structure 6, and is locked with the connector 63. The third connecting rod 71 located at an edge is fixed to the connecting head by inserting and threading, rendering the structure of the sunroom more stable. After installation is completed, the first supporting rod 111 and the second supporting rod 112 are added to enhance the stability. The present application is very convenient for installation, when disassembling, the connector 63 can also be twisted at a right angle. After releasing the flipping edge and clamp edge, it can be quickly disassembled. This sunroom is fixed by setting flipping edge and clamp edge on its frame for fixing the connector 63, as well as setting the first insertion slot 611, the second insertion slot 822, and the third insertion slot 723 to facilitate the installation of the insulation panel 1. Compared with traditional installation that uses too many screws, it is relatively more convenient and labor-saving.

In the present application, the base frame 2 and crossbeam 72 can be extended according to an actual site requirement, thereby extending the length of the sunroom.

The crossbeam 72 can be a single section structure or a combination of multiple crossbeams 72 for easy transportation. A specific length of crossbeam 72 can be set according to the size of the sunroom.

The above technical solution of the present disclosure provides a significantly different solution from the existing technology to address the technical problem of the existing technology being too single. However, the parts not covered in the technical solution of the present application are the same as the existing technology or can be implemented using the existing technology, and will not be repeated.

The technical solutions in the above embodiments have clearly and completely described the content of the present disclosure. Obviously, the described embodiments are only a part of the embodiments of the present disclosure, not all of them. Based on the embodiments in the present disclosure, all other embodiments obtained by those skilled in the art without creative work fall within the protection scope of the present disclosure.

What is claimed is:

1. A quick installation structure for a sunroom, comprising:

a connecting rod;

a crossbeam, which is provides with a first connecting unit and a second connecting unit;

a connector, which is connected to the connecting rod and comprises a locking portion, a pushing portion, and an actuating portion; the pushing portion matches with the locking portion, the actuating portion is connected to the locking portion and controls its movement; the locking portion is subjected by the pushing portion during movement and switches between a first state and a second state;

wherein the first connecting unit and the second connecting unit are symmetrically extended to two sides of the crossbeam, both the first connecting unit and the second connecting unit comprise a connecting portion, the first connecting portion comprises a first wall portion and a second wall portion; a groove is formed between the first wall portion and the second wall portion for the locking portion to be inserted, a first stop portion is formed on the first wall portion, a second stop portion is formed on the second wall portion;

when the locking portion is in the first state, it can freely pass through between the first stop portion and second stop portion; when the locking portion is in the second state, the locking portion is limited by the first stop portion and the second stop portion so as to limit it from detaching from the connecting portion between the first stop portion and the second stop portion.

2. The quick installation structure for a sunroom according to claim 1, wherein the first connecting unit and the second connecting unit both comprises a third insertion slot, the connecting rod is provided with a first insertion slot, the first insertion slot corresponds to the third insertion slot.

3. The quick installation structure for a sunroom according to claim 1, wherein an angle between the first connecting unit and the second connecting unit on the same crossbeam is 95-135 degrees.

4. The quick installation structure for a sunroom according to claim 1, wherein three groups of crossbeams are provided, the three groups of crossbeams are respectively connected by the connecting rod and connector; the first connecting unit of one group of two groups of crossbeams provided on two sides is parallel to the second connecting unit in the other group of the crossbeams.

5. The quick installation structure for a sunroom according to claim 1, wherein the locking portion comprises a first locking sheet and a second locking sheet, the first locking sheet has a first bending part, the second locking sheet has a second bending part, the first bending part is arranged in an opposite direction to the second bending part; in the second state, the first bending part abuts against the first stop portion, the second bending part abuts against the second stop portion.

6. The quick installation structure for a sunroom according to claim 1, wherein the actuating portion comprises an end, a shaft, and a cam, the shaft is connected to the end, the cam is provided on the shaft, an axis of the cam is spaced from the axis of the shaft; the first locking sheet and the second locking sheet are formed on the same sheet, the sheet has a hole that fits with the cam, the end is exposed to an outside of the connecting rod.

7. A sunroom, comprising:

a base frame, which is enclosed in a square shape;

a side panel structure, which is fixed to the base frame;

a door panel structure, which is fixed to the base frame;

a top panel structure, which forms a top of the sunroom and is connected to the side panel structure and/or door panel structure;

at least one of the side panel structure, door panel structure, or top panel structure comprises a quick installation structure, wherein the quick installation structure comprises:

a connecting rod;

a crossbeam, which is provided with a first connecting unit and a second connecting unit;

a connector, which is connected to the connecting rod and comprises a locking portion, a pushing portion, and an actuating portion; the pushing portion matches with the locking portion, the actuating portion is connected to the locking portion and controls its movement; the locking portion is subjected by the pushing portion during movement and switches between a first state and a second state;

the first connecting unit and the second connecting unit are symmetrically extended to two sides of the crossbeam, both the first connecting unit and the second connecting unit comprise a connecting portion, the connecting portion comprises a first wall portion and a second wall portion; a groove is formed between the first wall portion and the second wall portion for the locking portion to be inserted, a first stop portion is formed on the first wall portion, a second stop portion is formed on the second wall portion;

when the locking portion is in the first state, it can freely pass through between the first stop portion and the second stop portion; when the locking portion is in the second state, the locking portion is limited by the first stop portion and the second stop portion so as to limit it from detaching from the connecting portion between the first stop portion and the second stop portion.

8. The sunroom according to claim 7, further comprises an insulation panel, at least two sides of the insulation panel are respectively inserted into a third insertion slot of the crossbeam and a first insertion slot of the connecting rod that is connected to the crossbeam.

9. The sunroom according to claim 7, wherein two groups of side panel structures are provided, the two groups of side panel structures are provided on two sides of the top panel structure, the side panel structure comprises the quick installation structure, wherein the other end of the connecting rod of the quick installation structure relative to the crossbeam that it is connected to is connected to the base frame.

10. The sunroom according to claim 9, wherein the crossbeam of the quick installation structure of one group of side panel structures is connected to a drainage channel.

11. The sunroom according to claim 7, wherein a column connection is provided between side panel structure and the door panel structure that are adjacent.

12. The sunroom according to claim 8, wherein the top panel structure comprises the quick installation structure, the first connecting unit and second connecting unit of the crossbeam of the quick installation structure are respectively connected to the connecting rod through the connector, the other end of the connecting rod that it is connected to the crossbeam is connected to the crossbeam of the quick installation structure of the side panel structure through the connector.

13. The sunroom according to claim 7, wherein the top panel structure comprises a skylight.

14. The sunroom according to claim 7, wherein the door panel structure comprises a door, the door is connected to the door panel structure through a connection mechanism to achieve a translation or rotation opening of the door.

15. The sunroom according to claim 14, wherein the door panel structure comprises:

a second connecting rod, two second connecting rods are provided, a bottom of each second connecting rod is connected to the base frame, a top thereof abuts against the top panel structure;

a horizontal plug-in beam, two ends of the horizontal plug-in beam are connected to two second connecting rods;

a horizontal connecting rod, several horizontal connecting rods are provided, one end of each horizontal connecting rod is connected to one side of the second connecting rod, the other end thereof is connected to the side panel structure;

the second connecting rod, the horizontal plug-in beam, and the horizontal connecting rod are all provided with a second insertion groove, the door is installed between two second connecting rods.

16. The sunroom according to claim 7, wherein the door panel structure and the side panel structure are further connected to a first support rod for support.

* * * * *